US010533542B2

(12) United States Patent
Smith et al.

(10) Patent No.: US 10,533,542 B2
(45) Date of Patent: Jan. 14, 2020

(54) RAPIDLY MODULATED HYDRAULIC SUPPLY FOR A ROBOTIC DEVICE

(71) Applicant: Sarcos LC, Salt Lake City, UT (US)

(72) Inventors: Fraser M. Smith, Salt Lake City, UT (US); Marc X. Olivier, Salt Lake City, UT (US); Shane Olsen, Farmington, UT (US)

(73) Assignee: Sarcos LC, Salt Lake City, UT (US)

( * ) Notice: Subject to any disclaimer, the term of this patent is extended or adjusted under 35 U.S.C. 154(b) by 228 days.

(21) Appl. No.: 14/704,960

(22) Filed: May 5, 2015

(65) Prior Publication Data

US 2015/0323135 A1 Nov. 12, 2015

Related U.S. Application Data

(60) Provisional application No. 61/989,517, filed on May 6, 2014.

(51) Int. Cl.
*F04B 9/02* (2006.01)
*F17C 13/04* (2006.01)

(52) U.S. Cl.
CPC ..... *F04B 9/025* (2013.01); *F17C 13/04* (2013.01); *Y10T 137/0396* (2015.04); *Y10T 137/85978* (2015.04)

(58) Field of Classification Search
CPC ..... F04B 9/025; F04B 49/22; F04B 3/003; F04B 13/00; F04B 49/16; F04B 49/12;
(Continued)

(56) References Cited

U.S. PATENT DOCUMENTS 2,981,198 A * 4/1961 Nettel ..... F04B 19/022 417/250
3,358,678 A 12/1967 Kulstar
(Continued)

FOREIGN PATENT DOCUMENTS

CN 103610524 A 3/2014
DE 102010029088 A1 11/2011
(Continued)

OTHER PUBLICATIONS

Grabowski et al., Exoskeletons for Running and Hopping Augmentation, Journal of Applied Physiology, http://biomech.media.mit.edu/portfolio_page/load-bearing-exoskeleton-for-augmentation-of-human-running/, 2009, 4 pages, vol. 107, No. 3, American Physiological Society, United States.
(Continued)

*Primary Examiner* — Craig J Price
*Assistant Examiner* — Andrew J Rost

(57) ABSTRACT

A rapidly modulated hydraulic supply is disclosed. The rapidly modulated hydraulic supply can include a chamber for receiving fluid. The rapidly modulated hydraulic supply can also include a displacement member operable to displace the fluid from the chamber. In addition, the rapidly modulated hydraulic supply can include a flow modulation system operable to vary the flow rate of the fluid output from the chamber. A first flow rate corresponds to a first output pressure, and is different from a second flow rate corresponding to a second output pressure for a like movement of the displacement member.

10 Claims, 7 Drawing Sheets

(58) Field of Classification Search
CPC .. F17C 13/04; F15B 11/13; Y10T 137/85978; Y10T 137/0396; F16K 1/523; F01L 1/08; F01L 1/044; B23Q 5/345
USPC ..... 251/62, 285, 284; 91/505, 504; 92/12.2, 92/13; 74/567
See application file for complete search history.

(56) References Cited

U.S. PATENT DOCUMENTS

| | | | | |
|---|---|---|---|---|
| 3,449,769 | A | 6/1969 | Mizen | |
| 3,759,563 | A | 9/1973 | Kitamura | |
| 4,200,596 | A * | 4/1980 | Iiyama | F02M 3/08 123/339.13 |
| 4,398,110 | A | 8/1983 | Flinchbaugh et al. | |
| 4,723,353 | A | 2/1988 | Monforte | |
| 4,884,720 | A * | 12/1989 | Whigham | B67D 1/0037 222/129.3 |
| 5,785,505 | A * | 7/1998 | Price | F01M 1/02 123/71 R |
| 6,641,371 | B2 * | 11/2003 | Graziani | F04B 49/16 417/274 |
| 7,628,766 | B1 | 12/2009 | Kazerooni et al. | |
| 7,883,546 | B2 | 2/2011 | Kazerooni et al. | |
| 7,947,004 | B2 | 5/2011 | Kazerooni et al. | |
| 8,375,982 | B2 * | 2/2013 | Gray, Jr. | G05D 7/0641 137/493 |
| 8,435,309 | B2 | 5/2013 | Gilbert et al. | |
| 8,870,967 | B2 | 10/2014 | Herr et al. | |
| 9,295,604 | B2 | 3/2016 | Zoss et al. | |
| 9,333,097 | B2 | 5/2016 | Herr et al. | |
| 2002/0094919 | A1 | 7/2002 | Rennex et al. | |
| 2005/0059908 | A1 | 3/2005 | Bogert | |
| 2006/0064047 | A1 | 3/2006 | Shimada et al. | |
| 2006/0069449 | A1 | 3/2006 | Bisbee, III et al. | |
| 2006/0197049 | A1 * | 9/2006 | Hamada | F16K 31/1225 251/285 |
| 2007/0129653 | A1 | 6/2007 | Sugar et al. | |
| 2009/0036815 | A1 | 2/2009 | Ido | |
| 2009/0294238 | A1 | 12/2009 | Gilmore | |
| 2010/0094185 | A1 | 4/2010 | Amundson et al. | |
| 2010/0241242 | A1 | 9/2010 | Herr et al. | |
| 2011/0040216 | A1 | 2/2011 | Herr et al. | |
| 2011/0066088 | A1 | 3/2011 | Little et al. | |
| 2011/0264230 | A1 | 10/2011 | Herr et al. | |
| 2012/0073930 | A1 | 3/2012 | Lansberry et al. | |
| 2012/0137667 | A1 * | 6/2012 | Jacobsen | B60K 6/12 60/327 |
| 2012/0179075 | A1 | 7/2012 | Perry et al. | |
| 2012/0216671 | A1 * | 8/2012 | Gammon | F04B 13/00 91/422 |
| 2013/0192406 | A1 | 8/2013 | Godowski | |
| 2013/0226048 | A1 | 8/2013 | Unluhisarcikli et al. | |
| 2013/0253385 | A1 | 9/2013 | Goffer et al. | |
| 2013/0296746 | A1 | 11/2013 | Herr et al. | |
| 2013/0331744 | A1 | 12/2013 | Kamon | |
| 2013/0333368 | A1 | 12/2013 | Durfee et al. | |
| 2014/0100492 | A1 | 4/2014 | Nagasaka | |
| 2014/0190289 | A1 | 7/2014 | Zhu | |
| 2015/0173929 | A1 | 6/2015 | Kazerooni et al. | |
| 2015/0321342 | A1 | 11/2015 | Smith et al. | |
| 2016/0153508 | A1 | 6/2016 | Battlogg | |
| 2016/0331572 | A1 | 11/2016 | Popovic et al. | |
| 2016/0332302 | A1 | 11/2016 | Bingham et al. | |
| 2016/0332305 | A1 | 11/2016 | Gonzalez et al. | |
| 2018/0298976 | A1 | 10/2018 | Battlogg | |

FOREIGN PATENT DOCUMENTS

| | | | |
|---|---|---|---|
| EP | 2198810 | A1 | 6/2010 |
| EP | 2942162 | A2 | 11/2015 |
| EP | 2168548 | B1 | 10/2016 |
| GB | 686237 | A | 1/1953 |
| JP | S34-015764 | | 10/1959 |
| JP | S36-005228 | | 5/1961 |
| JP | S44-000603 | | 1/1969 |
| JP | S50-009803 | | 1/1975 |
| JP | S50-006043 | | 3/1975 |
| JP | S52-134985 | A | 11/1977 |
| JP | S58-113586 | A | 7/1983 |
| JP | S62-200600 | A | 9/1987 |
| JP | H06-213266 | A | 8/1994 |
| JP | H07-5129 | Y2 | 2/1995 |
| JP | 2003-103480 | A | 4/2003 |
| JP | 2005-118938 | A | 5/2005 |
| JP | 2006-051558 | A | 2/2006 |
| JP | 2007-130234 | A | 5/2007 |
| JP | 2007-252514 | A | 10/2007 |
| JP | 2007-307216 | A | 11/2007 |
| JP | 2009-023828 | A | 2/2009 |
| JP | 2009-178253 | A | 8/2009 |
| JP | 2009-219650 | A | 10/2009 |
| JP | 2009-240488 | A | 10/2009 |
| JP | 2009-268839 | A | 11/2009 |
| JP | 2010-110381 | A | 5/2010 |
| JP | 2010-110465 | A | 5/2010 |
| JP | 2010-142351 | A | 7/2010 |
| JP | 2011-193899 | A | 10/2011 |
| JP | 2012-501739 | A | 1/2012 |
| JP | 2012-125279 | A | 7/2012 |
| JP | 2013-022091 | A | 2/2013 |
| JP | 2013-090693 | A | 5/2013 |
| JP | 5267730 | | 8/2013 |
| JP | 2013-248699 | A | 12/2013 |
| JP | 2014-054273 | A | 3/2014 |
| JP | 2014-073222 | A | 4/2014 |
| JP | 2015-212010 | A | 11/2015 |
| KR | 2007-0057209 | A | 6/2007 |
| KR | 2012-0105194 | A | 9/2012 |
| KR | 10-1219795 | | 1/2013 |
| KR | 2013-0001409 | A | 1/2013 |
| KR | 2013-0045777 | A | 5/2013 |
| WO | WO 2003/081762 | A1 | 10/2003 |
| WO | WO 2010/025409 | A1 | 3/2010 |
| WO | WO 2012/042471 | A1 | 4/2012 |
| WO | WO 2017/148499 | A1 | 9/2017 |
| WO | WO 2018/118004 | A1 | 6/2018 |
| WO | WO 2018/215705 | A1 | 11/2018 |

OTHER PUBLICATIONS

Elliott et al., Design of a Clutch-Spring Knee Exoskeleton for Running, Journal of Medical Devices, Sep. 2014, 11 pages, vol. 8, The American Society of Mechanical Engineers, New York City, NY.

Elliott et al., The Biomechanics and Energetics of Human Running using an Elastic Knee Exoskeleton, Jun. 2013, 7 pages, IEEE International Conference on Rehabilitation Robotics, Seattle, WA.

Hauser et al., JammJoint: A Variable Stiffness Device Based on Granular Jamming for Wearable Joint Support, IEEE Robotics and Automation Letters, Apr. 2017, 7 pages, vol. 2, Issue 2, IEEE, Piscataway, NJ.

Jafari et al., A Novel Actuator with Adjustable Stiffness (AwAS), Oct. 18-22, 6 pages, 2010, IEEE/RSJ International Conference on Intelligent Robots and Systems, Taiwan.

Kulick, An Unpowered Exoskeleton Springs Into Action: Researchers Increase Walking Efficiency, http://www.cmu.edu/me/news/archive/2015/collins-clutch.html, Apr. 1, 2015, 2 pages, Carnegie Mellon University Mechanical Engineering, Pittsburgh, PA.

Miao et al., Mechanical Design of Hybrid Leg Exoskeleton to Augment Load-Carrying for Walking, International Journal of Advanced Robotic Systems, Mar. 28, 2013, 11 pages, vol. 10, Intech open science open minds, Europe.

Mombaur et al., HEiKA-EXO: Optimization-based development and control of an exoskeleton for medical applications, http://typo.iwr.uni-heidelberg.de/groups/orb/research/heika-exo/, Optimization in Robotics & Biomechanics, Oct. 20, 2014, 3 pages, Germany.

Pan, Improved Design of a Three-degree of Freedom Hip Exoskeleton Based on Biomimetic Parallel Structure, Jul. 2011, 132 pages, University of Ontario Institute of Technology, Canada.

(56) References Cited

OTHER PUBLICATIONS

Pratt et al., The RoboKnee: An Exoskeleton for Enhancing Strength and Endurance During Walking, International Conference on Robotics & Automation, Apr. 2004, 6 pages, IEEE, New Orleans, LA.
Searchmap Blog, Scientists Develop Mechanical Spring-Loaded Leg Brace to Improve Walking, http://www.searchmap.eu/blog/scientists-develop-mechanical-spring-loaded-leg-brace-to-improve-walking/, Apr. 1, 2015, 5 pages, Searchmap Blog.
Seppala, These exoskeleton heels could help stroke victims walk again, http://www.engadget.com/2015/04/02/feet-exoskeletons/, Apr. 2, 2015, Engadget, San Francisco, CA.
Siddharth et al., Design and Analysis of a 1-DOF Walking Mechanism, http://siddharthswaminathan.in/files/WalkingMechanism.pdf, Nov. 2012, 7 pages, India.
Suitx, Phoenix Medical Exoskeleton, http://www.suitx.com/phoenix-medical-exoskeleton, 3 pages, to the best of the applicant's knowledge article was available before the application filing date of May 5, 2015, US Bionics, Inc., Berkeley, CA.
Suleiman, Engineering an affordable exoskeleton, Phys.org, http://phys.org/news/2014-06-exoskeleton.html, Jun. 12, 2014, 5 pages, Science X network.
Vanderborght et al., Variable impedance actuators: A review, Robotics and Autonomous Systems, Dec. 2013, 14 pages, vol. 61, Issue 12, Elsevier, Netherlands.
Walsh, Biomimetic Design of an Under-Actuated Leg Exoskeleton for Load-Carrying Augmentation, Massachusetts Institute of Technology, Feb. 2006, 97 pages, Massachusetts.
Walsh et al., A Quasi-Passive Leg Exoskeleton for Load-Carrying Augmentation, International Journal of Humanoid Robotics, Mar. 8, 2007, 20 pages, vol. 4, No. 3, World Scientific Publishing Company.
Zubrycki et al., Novel haptic glove-based interface using jamming principle, Proceedings of the $10^{th}$ International Workshop on Robot Motion and Control, Jul. 6-8, 2015, 6 pages, IEEE, Poland.
EP Search Report for EP Application No. 15166668.2, dated Oct. 19, 2015, 6 pages.
EP Search Report for EP Application No. 15166669.0, dated Dec. 10, 2015, 12 pages.
EP Search Report for EP Application No. 15166667.4, dated Feb. 19, 2016, 11 pages.
EP Search Report for EP Application No. 15166664.1, dated Apr. 15, 2016, 9 pages.
EP Search Report for EP Application No. 17201464.9, dated Apr. 26, 2018, 8 pages.
EP Search Report for EP Application No. 17201467.2, dated Apr. 26, 2018, 7 pages.
EP Search Report for EP Application No. 17201466.4, dated Apr. 30, 2018, 8 pages.
EP Search Report for EP Application No. 18210380.4, dated Mar. 27, 2019, 9 pages.
EP Search Report for EP Application No. 18213196.1, dated Apr. 8, 2019, 11 pages.

* cited by examiner

RAPIDLY MODULATED HYDRAULIC SUPPLY FOR A ROBOTIC DEVICE

RELATED APPLICATION

This application claims the benefit of U.S. Provisional Application No. 61/989,517, filed May 6, 2014, which is incorporated by reference in its entirety herein.

BACKGROUND

A wide variety of exoskeleton, humanoid, and other legged robot systems exist. The fundamental technical problem to be solved for such systems, where energetic autonomy is concerned, is power. Two options are available: use a high-output power supply that can meet the demands of the robotic system, or use less power. The first option lacks practicality, inasmuch as portable power remains a challenge, which leaves the second option. Accordingly, the exoskeletons or ambulatory robots currently in existence are not capable of providing high force outputs for prolonged periods of time. In other words, the power issue has been a challenging obstacle, with the typical solution being to reduce the force output capabilities of the system.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
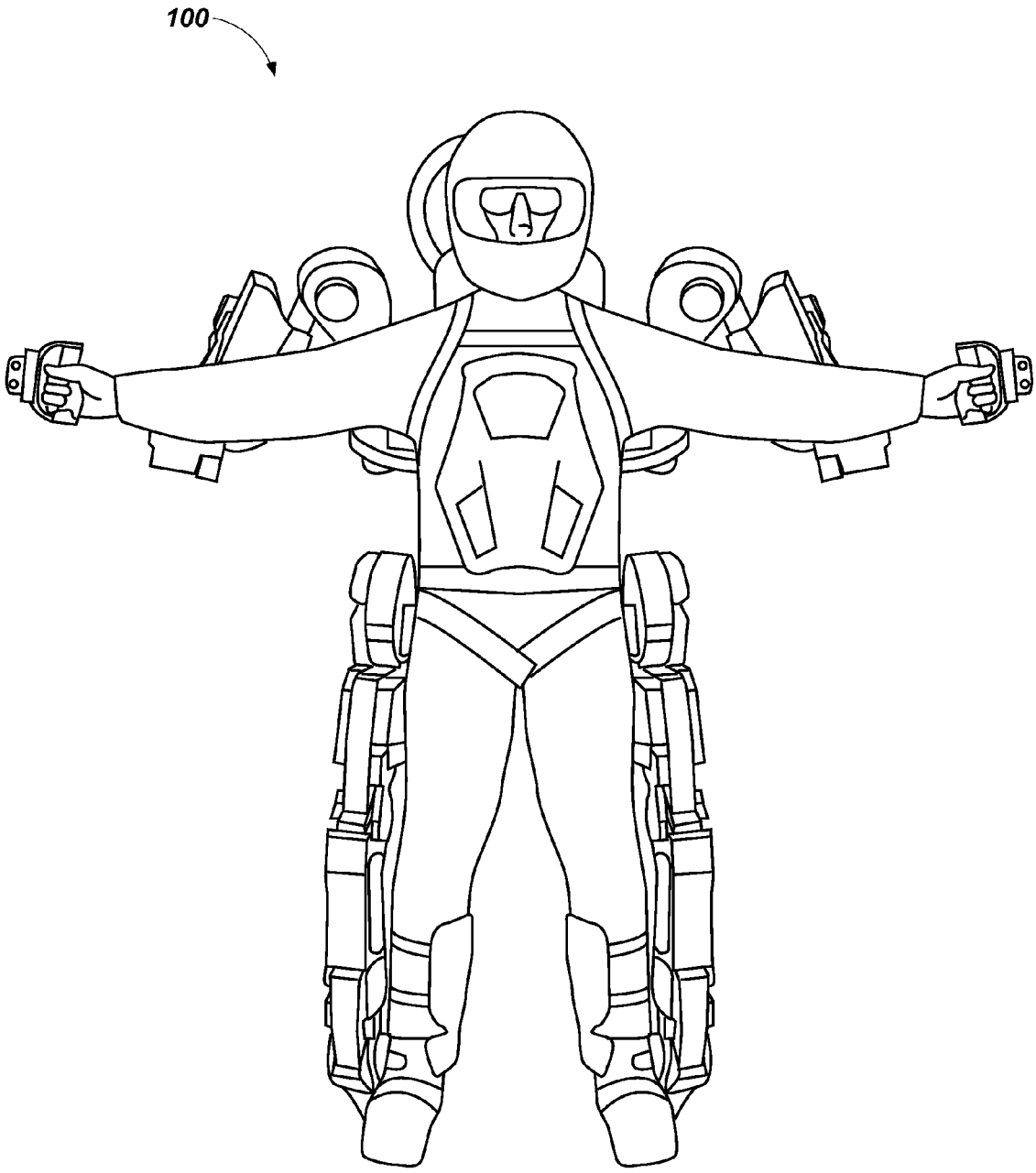
FIG. 1 is an illustration of a robotic device in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

In order to improve an exoskeleton, humanoid, or other legged robot system's force output and endurance capabilities with limited power available, the efficiency of such systems can be the focus of improvement. For example, in a typical hydraulic system powering a robotic device, high pressures upwards of 3000 psi are maintained for use by hydraulic actuators. Much of the time power is wasted, as a majority of the actual pressure demands during use are far less than the pressure that is continually provided. Nonetheless, the high pressure levels are maintained and available for those situations where such power is needed or wanted. However, not only does the pressure waste energy, but the heat produced by the act of dumping the pressure to the desired level is a dissipative process that is also a heat generating process, which creates additional problems that lead to greater inefficiencies.

Accordingly, a rapidly modulated hydraulic supply for a new robotic system is disclosed that improves efficiency over a hydraulic supply of a typical robotic system. In one aspect, flow rate is variable to produce pressures and flow suitable to meet the instantaneous demands of the robotic system. The rapidly modulated hydraulic supply can include a chamber for receiving fluid. The rapidly modulated hydraulic supply can also include a displacement member operable to displace the fluid from the chamber. In addition, the rapidly modulated hydraulic supply can include a flow modulation system operable to vary the flow rate of the fluid output from the chamber. A first flow rate corresponds to a first output pressure, and is different from a second flow rate corresponding to a second output pressure for a like or similar movement of the displacement member.

An example of a robotic device 100 is illustrated in FIG. 1. The robotic device 100 can be configured as an exoskeleton structure for attachment to a human body or as a humanoid robot and can be used in applications relevant to the military, first responders, the commercial sector, etc. The robotic device 100 can include support members coupled together for relative movement defining degrees of freedom, which can correspond to degrees of freedom of a human extremity.

A human user or operator may use or interact with the robotic device 100 by placing his or her feet into a foot portion of the device, where the feet of the operator can be in contact with a corresponding force sensor. Portions of the human operator can also be in contact with force sensors disposed on various locations of the robotic device 100. For example, a hip portion or a shoulder portion of the robotic device 100 can have a force sensor configured to interact with the operator's hip or shoulder, respectively. The operator can be coupled to the robotic device 100 by a waist strap, shoulder strap or other appropriate coupling device. The operator can be further coupled to the robotic device 100 by a foot strap and/or a handle for the operator to grasp. In one aspect, a force sensor can be located about a knee portion or an elbow portion of the legged robotic device 100 near a knee or a shoulder, respectively, of the operator. While reference is made to force sensors disposed at specific locations on or about the legged robotic device 100, it should be understood that force sensors can be strategically placed at numerous locations on or about the robotic device 100 in order to facilitate proper operation of the robotic device 100.

Figure 2:
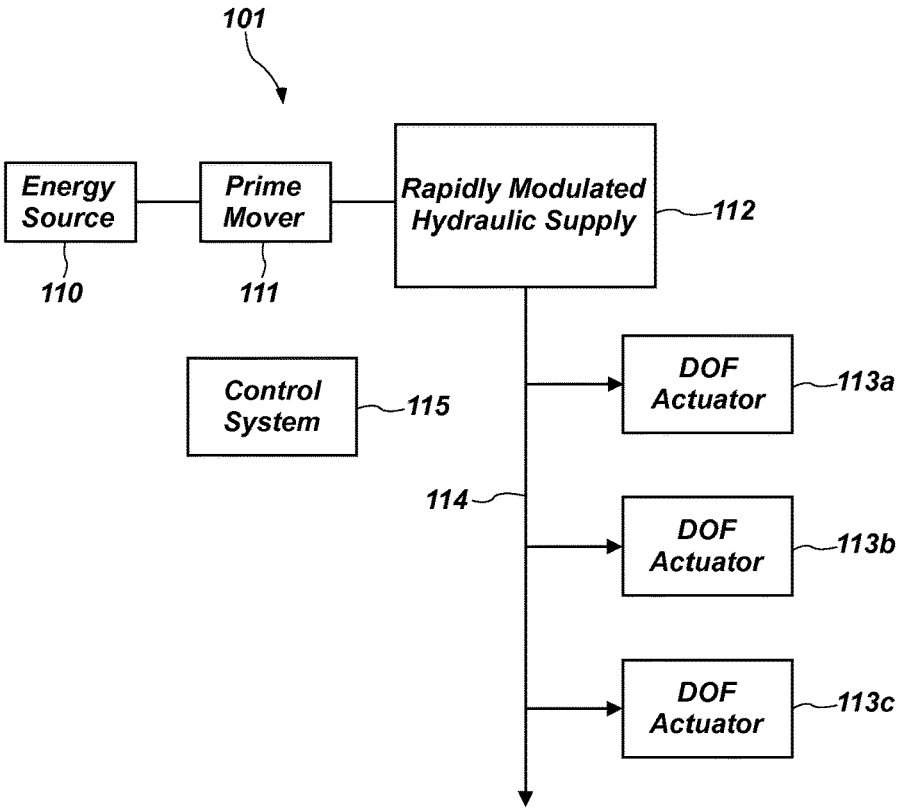
FIG. 2 is a schematic illustration of a power system for the robotic device of FIG. 1, in accordance with an example of the present disclosure.

FIG. 2 is a schematic illustration of a power system 101 for the robotic device 100. The power system 101 can include an energy source 110, such as a battery, a turbine generator, a fossil fuel, and others to provide energy for a prime mover 111, which can be an electric motor, an internal combustion engine, for example. The prime mover 111 can be mechanically and/or electrically coupled to a rapidly modulated hydraulic supply 112, which can serve as a hydraulic pump to provide pressurized fluid for hydraulic actuators 113*a-c* used to actuate one or more degrees of freedom of the robotic device 100. In one aspect, the rapidly modulated hydraulic supply 112 can be fluidly connected to the actuators 113*a-c* via a fluid bus 114. Thus, a single rapidly modulated hydraulic supply 112 can provide fluid for any number or combination of actuators to actuate degrees of freedom of the robotic device 100. For example, a single rapidly modulated hydraulic supply 112 can be configured to provide pressurized fluid for all the actuators of a leg or arm of the robotic device, a side (i.e., right or left) of the robotic device 100, or a grouping of extremities (i.e., both legs or both arms) of the robotic device 100. A control system 115 can be configured to control operation of the prime mover 111, the rapidly modulated hydraulic supply 112, and/or the actuators 113*a-c* based on, at least in part, input from the various sensors disposed about the robotic device 100, such as to facilitate efficient operation of the robotic device 100 as discussed in more detail below. For example, variable hydraulic pressure can be utilized to minimize waste and improve performance efficiencies. In one aspect, the rapidly modulated hydraulic supply 112 can vary the supply pressure dynamically, thus providing only a hydraulic system pressure that is needed at any given time. Otherwise, as is the case with typical robotic systems, energy is wasted and heat is generated. For example, in the case of the robotic device 100 of FIG. 1, the rapidly modulated hydraulic supply 112 can dynamically vary the pressure to supply what is needed for the two robotic legs to operate. In typical operation of a robot, such the robotic device 100, the pressure required by the actuators varies over time. In other words, a "pressure profile," which is pressure as a function of time, fluctuates as the robotic device 100 performs different movements and tasks. For example, in a walking motion, higher pressure would be provided as the leg contacts the ground following a swinging motion (where the pressure is low). Dynamically varying the pressure to substantially match the pressure profile and supply what is needed through the walking motion can reduce the amount of waste. Although there are different pressure profiles depending upon the motions of the robotic device 100, the power system 101 can be configured to account for these and dynamically vary pressure across differing operational situations or conditions. Thus, one advantage of the power system 101 is a reduction of the pressure needed to operate the robotic device 100.

One exemplary way to dynamically vary pressure in the hydraulic system is to configure the power system 101 such that the rapidly modulated hydraulic supply 112 operates both legs so as to reduce the power requirements for each leg. Another example configuration of the power system 101 is to include two rapidly modulated hydraulic supplies 112, utilizing one rapidly modulated hydraulic supply 112 per leg. In this case, the pressure profile of each leg can be followed continuously over time. Doing this can reduce the power requirements even further over the previous example where only a single variable hydraulic supply is provided because optimization can occur on a per leg basis.

Figure 3:
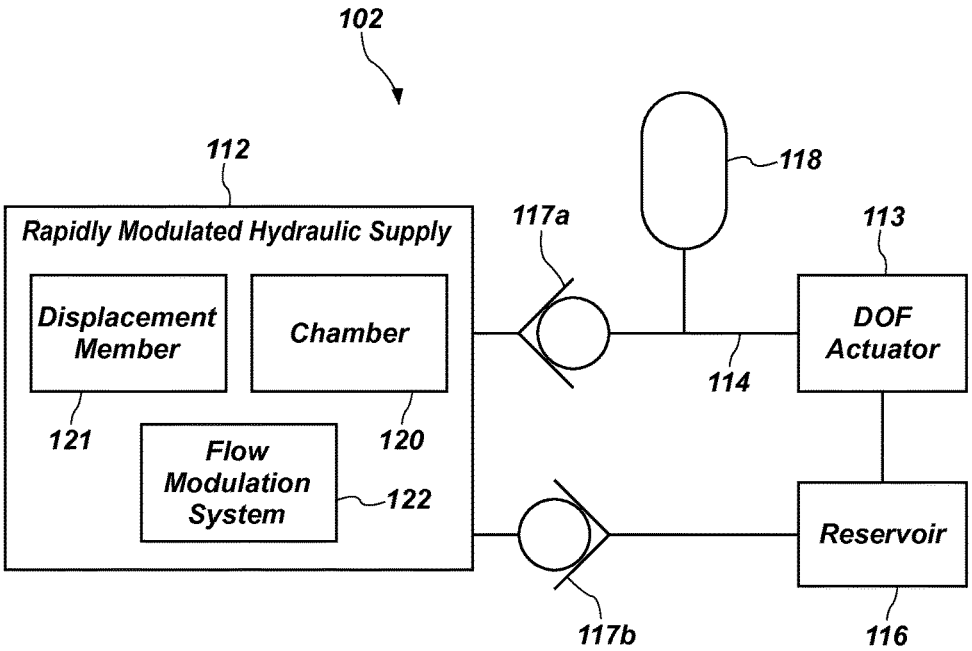
FIG. 3 is a schematic illustration of a hydraulic system of the power system of FIG. 2, in accordance with an example of the present disclosure.

FIG. 3 is a schematic illustration of a hydraulic system 102 of the power system 101. The hydraulic system 102 can include the rapidly modulated hydraulic supply 112 and one of the actuators 113 for actuating a degree of freedom of the robotic device 100, which is coupled to the rapidly modulated hydraulic supply 112 via the fluid bus 114 or other suitable hydraulic line. Fluid from actuator 113 can return to a reservoir 116, from which fluid can be provided to the rapidly modulated hydraulic supply 112. In general, check valves 117*a*, 117*b* coupled to an outlet and an inlet of the hydraulic supply 112, respectively, can ensure proper fluid flow into and out of the hydraulic supply 112. The hydraulic system 102 can also include an accumulator 118 to accommodate pressure fluctuations (i.e., store energy to support power transients) in the fluid bus 114 or fluid supply line and provide flow smoothing. By controlling the output flow of the rapidly modulated hydraulic supply 112, the amount of fluid stored in the accumulator 118, and as a result the system hydraulic pressure, can be varied dynamically.

The rapidly modulated hydraulic supply 112 can include a chamber 120 for receiving fluid from the reservoir 116. The hydraulic supply 112 can also include a displacement member 121 operable to displace the fluid from the chamber 120. In addition, the hydraulic supply 112 can include a flow modulation system 122 operable to vary the flow rate of the fluid output from the hydraulic supply 112. Various flow modulation systems are discussed below. In one aspect, a first flow rate corresponds to a first output pressure, and is different from a second flow rate corresponding to a second output pressure for a similar or like movement of the displacement member 121. In other words, for example in an embodiment in which the displacement member comprises a piston, the displacement member 121 can move with a consistent stroke length throughout operation of the hydraulic supply 112 and due to the flow modulation system 122, the flow rate provided by the hydraulic supply 112 can vary. In one aspect, the rate at which the displacement member 121 cycles within the chamber 120 can remain substantially constant and the flow modulation system 122 can cause the flow to vary. In other words, the flow modulation system 122 can effectively modulate the flow rate of the hydraulic supply 112 independent of the action or motion of the displacement member 121. In one aspect, the prime mover 111 can be operated at near constant speed and average power input, thereby largely eliminating inertia related losses associated with accelerating and decelerating the prime mover 111 and/or the hydraulic supply 112. In another aspect, output pressure of the hydraulic supply 112 can be controlled by modulating the flow rate from the hydraulic supply 112, and as a consequence the accumulator 118 charge level.

FIGS. 4A-4D illustrate a rapidly modulated hydraulic supply 212 in accordance an example of the present disclosure. Hydraulic fluid plumbing and valving features or components, such as inlet and outlet lines, check valves, etc., have been omitted for clarity. The hydraulic supply 212 includes a chamber 220, a displacement member 221, and a flow modulation system 222. In this case, the chamber 220 can comprise a cylinder and the displacement member 221 can comprise a piston disposed in the cylinder and configured for reciprocal or cyclical movement therein. In one aspect, the displacement member 221 can be coupled to a crankshaft 230 via a connecting rod 231, which can cause the displacement member 221 to move within the chamber 220 as the crankshaft rotates in direction 232. A flywheel 233 can be associated with the crankshaft 230 to provide energy storage for transient operation.

Figure 4A:
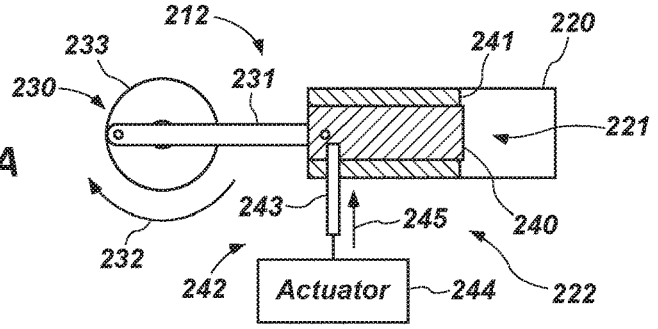
FIGS. 4A-4D illustrate a rapidly modulated hydraulic supply in accordance an example of the present disclosure.
Figure 4B:
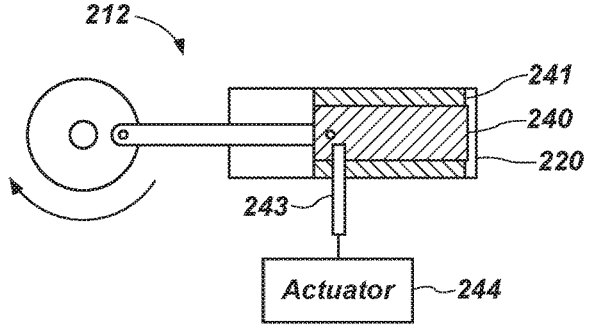
Figure 4C:
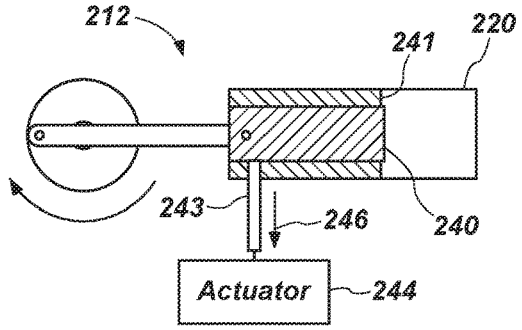
Figure 4D:
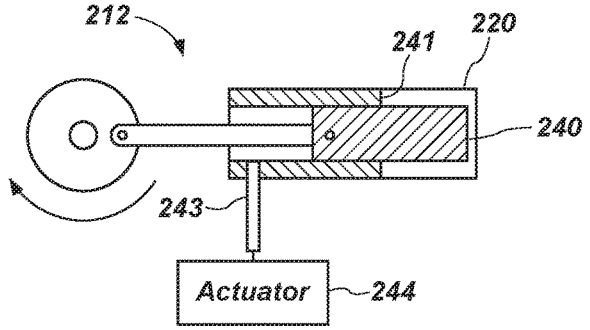

The flow modulation system 222 can include a first portion 240 of the piston and a second portion 241 of the piston, which are moveable relative to one another. In one aspect, the second portion 241 of the piston can form a sleeve about at least a part of the first portion 240 of the piston. The flow modulation system 222 can also include a coupling mechanism 242, which can include a pin 243, configured to selectively couple and uncouple the first portion 240 and the second portion 241 of the piston to/from one another. In one aspect, the coupling mechanism 242 can include an actuator 244 (e.g., a solenoid, an electric motor, a pneumatic actuator, and/or a hydraulic actuator), to cause the pin 243 to couple and uncouple the first portion 240 and the second portion 241 of the piston. For example, the actuator 244 can cause the pin 243 to move in direction 245 (FIG. 4A) to couple the first portion 240 and the second portion 241 of the piston to one another, and the actuator 244 can cause the pin 243 to move in direction 246 (FIG. 4C) to uncouple the first portion 240 and the second portion 241 of the piston from one another. In this way, the piston can have a variable piston area or can provide a variable displacement, thus providing the hydraulic supply 212 with a variable geometry. In one aspect, coupling and uncoupling of the first portion 240 and the second portion 241 of the piston can occur at bottom dead center, as shown in FIGS. 4A and 4C, where the movable piston portions 240, 241 are at or near zero velocity and loading on the piston portions 240, 241 is at a minimum.

Thus, when the first portion 240 and the second portion 241 of the piston are coupled to one another both portions are caused to move together (FIG. 4B) as forces from the crankshaft are transferred to both the first and second portions 240, 241 via the pin 243. As a result, reciprocal movement of the first portion 240 and the second portion 241 of the piston provides a first flow rate from the hydraulic supply 212. When the first portion 240 and the second portion 241 of the piston are uncoupled from one another (FIG. 4D) the first portion 240 moves independently of the second portion as no forces from the crankshaft are transferred to the second portion 241. In this case, the second portion 241 can be held stationary and reciprocal movement of the first portion 240 of the piston provides a second flow rate from the hydraulic supply 212, which is lower than the first flow rate, due to the relatively smaller pumping displacement provided by the first portion 240 of the piston alone. In operation, the actuator 244 can be controlled to rapidly insert and remove the pin 243 to couple and uncouple the first and second portions 240, 241 on any given cycle of the piston to vary the flow rate as desired. In one aspect, the actuator 244 can require a low power to operate, thereby minimizing the power required to modulate the flow rate provided by the hydraulic supply 212.

FIGS. 5A-5D illustrate a rapidly modulated hydraulic supply 312 in accordance another example of the present disclosure. Non-essential hydraulic fluid plumbing and valving features or components, such as inlet and outlet lines, check valves, etc., have been omitted for clarity. The hydraulic supply 312 includes a chamber 320, a displacement member 321, and a flow modulation system 322. In one aspect, the chamber 320 can comprise a cylinder and the displacement member 321 can comprise a piston disposed in the cylinder and configured for reciprocal or cyclical movement therein.

Figure 5A:
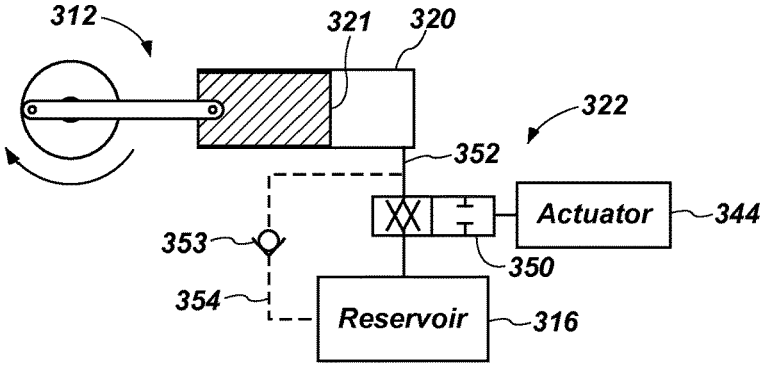
FIGS. 5A-5D illustrate a rapidly modulated hydraulic supply in accordance another example of the present disclosure.
Figure 5B:
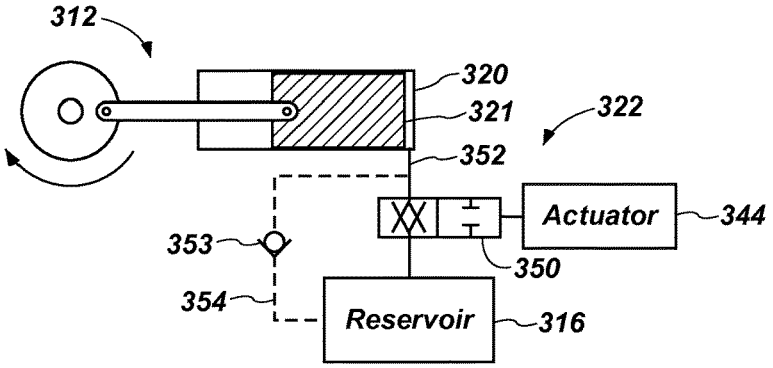
Figure 5C:
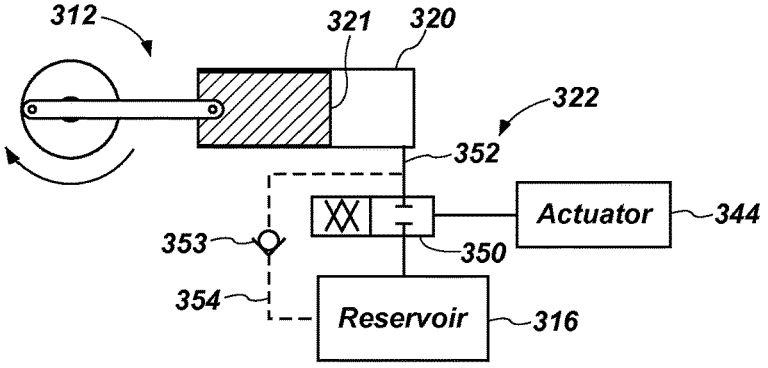
Figure 5D:
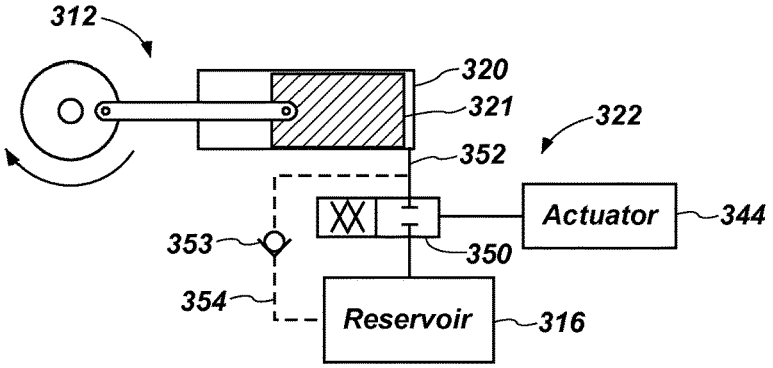

The flow modulation system 322 can include a valve 350, which can be a high throughput valve, between the chamber 320 and a fluid reservoir 316 configured to selectively open and close. An actuator 344 can be included to cause the valve 350 to open and close. In one aspect, the actuator 344 can comprise a solenoid. When the valve 350 is open to allow fluid to flow therethrough (FIGS. 5A and 5B), reciprocal movement of the displacement member 321 draws fluid from the fluid reservoir 316 into the chamber 320 and provides a first flow rate from hydraulic supply 312, and therefore the hydraulic supply 312 is pumping fluid. When the valve 350 is closed to prevent the flow of fluid therethrough (FIGS. 5C and 5D), reciprocal movement of the displacement member 321 provides substantially no fluid output from the chamber 320, and therefore the hydraulic supply 312 is not pumping fluid. When the hydraulic supply 312 is not pumping fluid, the prime mover can operate at low power, thus providing a power savings. In one aspect, the valve 350 can be opened and closed when the displacement member 321 is at bottom dead center, as shown in FIGS. 5A and 5C, where the displacement member 321 is at or near zero velocity and loading on the displacement member 321 is at a minimum.

In one aspect, the valve 350 can comprise a one-way or check valve to prevent fluid from being forced by the displacement member 321 back to the reservoir 316 when pumping. Alternatively, a check valve can be located at 352 between the chamber 320 and the valve 350 to prevent fluid from being forced by the displacement member 321 back to the reservoir 316 when pumping.

In an alternative embodiment, a check valve 353 can be included in a fluid conduit 354 coupling the reservoir 316 and the chamber 320, such that the check valve 353 is in parallel with the valve 350 between the reservoir 316 and the chamber 320. In this configuration, when the valve 350 is closed to prevent the flow of fluid therethrough (FIGS. 5C and 5D), reciprocal movement of the displacement member 321 draws fluid from the fluid reservoir 316 into the chamber 320 via the fluid conduit 354 and the check valve 353 and provides a first flow rate from hydraulic supply 312. Therefore, the hydraulic supply 312 is pumping fluid. When the valve 350 is open to allow fluid to flow therethrough (FIGS. 5A and 5B), reciprocal movement of the displacement member 321 draws fluid into the chamber 320 and forces fluid from the chamber 320 via the valve 350, such that the displacement member 321 provides substantially no fluid output from the chamber 320. Therefore, the hydraulic supply 312 is not pumping fluid.

In operation, the actuator 344 can be controlled to rapidly open and close the valve 350 to permit or prevent pumping on any given cycle of the displacement member 321 to vary the flow rate as desired. Thus, selective opening and closing of the valve 350 can provide a second flow rate provided by the hydraulic supply 312. In one aspect, the actuator 344 can require a low power to operate, thereby minimizing the power required to modulate the flow rate provided by the hydraulic supply 312.

FIGS. 6A-6D illustrate a rapidly modulated hydraulic supply 412 in accordance yet another example of the present disclosure. Hydraulic fluid plumbing and valving features or components, such as inlet and outlet lines, check valves, etc., have been omitted for clarity. The hydraulic supply 412 includes a chamber 420, a displacement member 421, and a flow modulation system 422. In one aspect, the chamber 420 can comprise a cylinder and the displacement member 421 can comprise a piston disposed in the cylinder and configured for reciprocal or cyclical movement therein.

The flow modulation system 422 can include a moveable head 460 disposed in the chamber 420 and opposed to the displacement member 421. The movable head 460 can be movable in a direction 464, parallel with a movement direction of the displacement member 421, within the chamber 420. The flow modulation system 422 can also include a range of motion limitation mechanism 461 to limit a range of motion of the moveable head 460 in the chamber 420 between a first range of motion and a second range of motion. In one aspect, the range of motion limitation mechanism 461 can comprise a movable stop member 462. An actuator 444 can be included to cause the movable stop member 462 to move, as described in more detail below. In one aspect, the actuator 444 can comprise a solenoid.

Figure 6A:
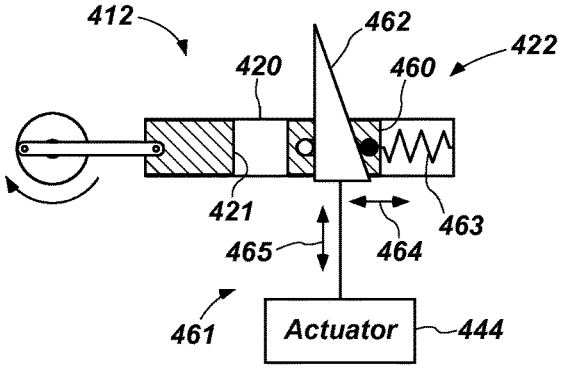
FIGS. 6A-6D illustrate a rapidly modulated hydraulic supply in accordance yet another example of the present disclosure.
Figure 6B:
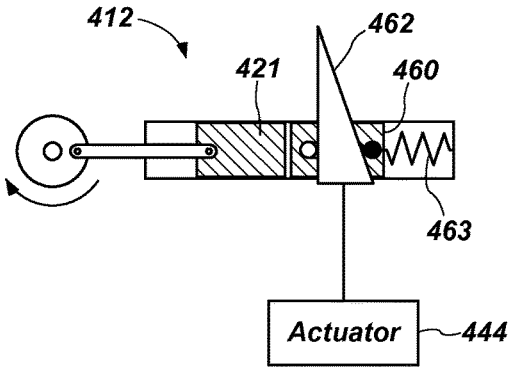
Figure 6C:
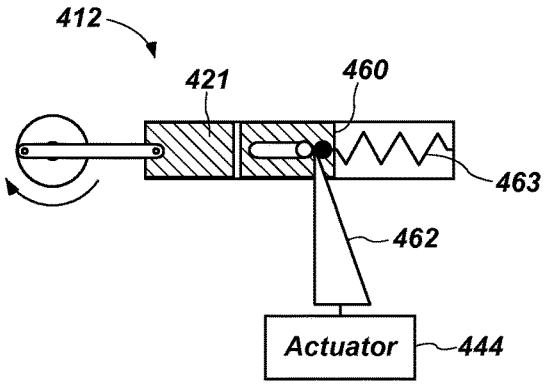
Figure 6D:
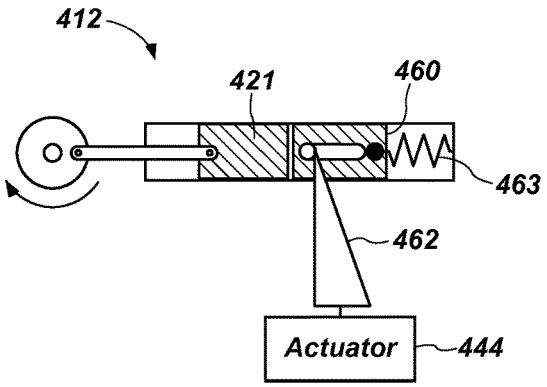

The movable stop member 462 can be operable with the movable head 460 to provide the first range of motion at a first position (e.g., as in FIGS. 6A and 6B) and the second range of motion at a second position (e.g., as in FIGS. 6C and 6D). For example, the movable stop member 462 can be movable relative to the movable head 460, such as in a direction 465, which may be perpendicular to the direction 464 of the movable head 460. The movable stop member 462 can be configured to interface with the movable head 460, or a component extending therefrom, to provide a stop for the movable head 460, which can establish or define a range of motion for the movable head 460. The movable stop member 462 can have a wedge configuration, as shown, or any other suitable configuration. In one aspect, the range of motion of the movable head 460 can vary based on a relative (i.e., lateral) position of the movable stop member 462 and the movable head 460.

For example, when the movable stop member 462 is at the position shown in FIGS. 6A and 6B with a wide portion of the wedge configuration engaged with the movable head 460, the movable head 460 can be prevented from moving. In this case, the first range of motion of the movable head is zero. With the movable head 460 fixed relative to the chamber 420, reciprocal movement of the displacement member 421 within the chamber 420 can effectively pump fluid from the hydraulic supply 412. In other words, the hydraulic supply 412 can function to provide a high output in this configuration with the wedge configuration of the movable stop member 462 fully inserted. Thus, the first range of motion can be such that movement of the displacement member 421 is operable with the movable head 460 to provide a first flow rate from the hydraulic supply 412.

On the other hand, when the movable stop member 462 is at the position shown in FIGS. 6C and 6D, with a narrow portion of the wedge configuration engaged with the movable head 460 or the movable member 462 is retracted or withdrawn such that no contact occurs between the movable head 460 and the movable stop member 462, the movable head 460 may move within the chamber 420 as limited by the second range of motion. With the movable head 460 movable relative to the chamber 420 as shown in FIGS. 6C and 6D, reciprocal movement of the displacement member 421 within the chamber 420 is less effective or ineffective to pump fluid from the hydraulic supply 412 as the pressure created by the displacement member 421 is absorbed by the movable head 460. In other words, little or no pressure can be created within the chamber 420 by movement of the displacement member 421 when the movable head 460 is allowed to move toward the position as shown in FIGS. 6C and 6D. Thus, the second range of motion can be such that movement of the displacement member 421 is operable with the movable head 460 to provide a second flow rate from the hydraulic supply 412, which is lower than the first flow rate, depending upon the position of the movable stop member 462. In some cases, the second flow rate may be zero.

In one aspect, the movable head 460 can be biased toward the displacement member 421, such that the movable head 460 can move with the displacement member 421 within the available range of motion. For example, a spring 463 can be included to bias the movable head 460 toward the displacement member 421. In this scenario, only a portion of the pressure is lost by movement of the movable head 460, with some of the pressure acting to provide the second flow rate above zero, but still at a lower pressure than the first flow rate.

In operation, the actuator 444 can be controlled to rapidly insert and retract the movable stop member 462 to permit or reduce/prevent pumping on any given cycle of the displacement member 421 to vary the flow rate as desired, depending upon the selected position of the movable stop member 462. Thus, the movable stop member 462 can be selectively inserted and retracted to provide a desired flow rate from the hydraulic supply 412. In one aspect, the actuator 444 can require a low power to operate, thereby minimizing the power required to modulate the flow rate provided by the hydraulic supply 412.

FIGS. 7A-7D illustrate a rapidly modulated hydraulic supply 512 in accordance yet another example of the present disclosure. Non-essential hydraulic fluid plumbing and valving features or components, such as inlet and outlet lines, check valves, etc., have been omitted for clarity. The hydraulic supply 512 includes a chamber 520, a displacement member 521, and a flow modulation system 522. In one aspect, the chamber 520 can comprise a cylinder and the displacement member 521 can comprise a piston disposed in the cylinder and configured for reciprocal or cyclical movement therein.

The flow modulation system 522 can include an inlet valve 570 between the chamber 520 and a fluid reservoir 516. The inlet valve 570 can be movable in a direction 564, parallel with a movement direction of the displacement member 521. The flow modulation system 522 can also include a range of motion limitation mechanism 561 to limit a range of motion for the inlet valve 570 between a first range of motion and a second range of motion. In one aspect, the range of motion limitation mechanism 561 can comprise a movable stop member 562. An actuator 544 can be included to cause the movable stop member 562 to move, as described in more detail below. In one aspect, the actuator 544 can comprise a solenoid.

Figure 7A:
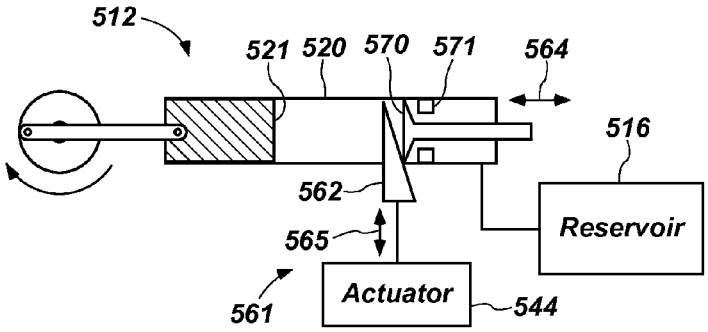
FIGS. 7A-7D illustrate a rapidly modulated hydraulic supply in accordance still another example of the present disclosure.
Figure 7B:
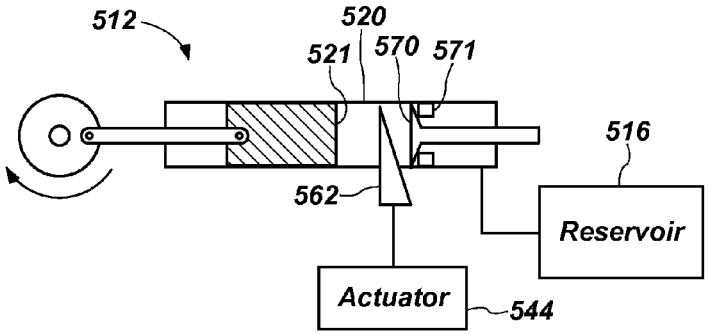
Figure 7C:
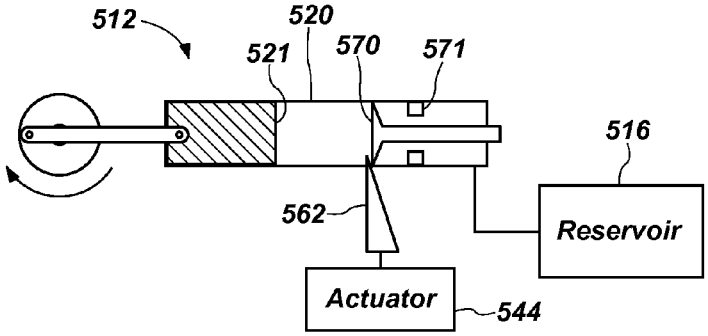
Figure 7D:
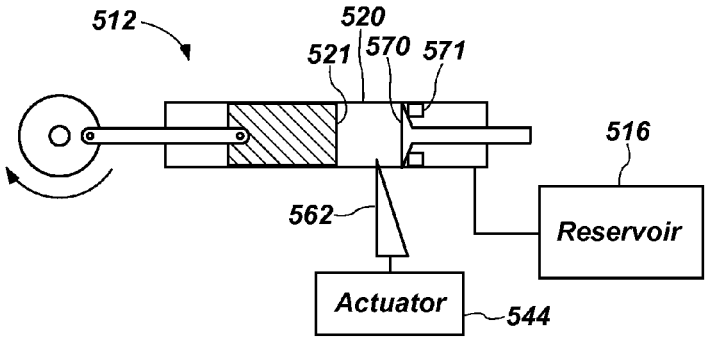

The movable stop member 562 can be operable with the inlet valve 570 to provide the first range of motion at a first position (e.g., as in FIGS. 7A and 7B) and the second range of motion at a second position (e.g., as in FIGS. 7C and 7D). For example, the movable stop member 562 can be movable relative to the inlet valve 570, such as in a direction 565, which may be perpendicular to the direction 564 of the inlet valve 570. The movable stop member 562 can be configured to interface with the inlet valve 570 to provide a stop for the inlet valve 570, which can establish or define a range of motion for the inlet valve 570 between the movable stop member 562 and a valve seat 571. The movable stop member 562 can have a wedge configuration, as shown, or any other suitable configuration. In one aspect, the range of motion of the inlet valve 570 can vary based on a relative (i.e., lateral) position of the movable stop member 562 and the inlet valve 570.

For example, when the movable stop member 562 is at the position shown in FIGS. 7A and 7B with a wide portion of the wedge configuration in a position to engage the inlet valve 570, the inlet valve 570 may move from the valve seat 571 to the movable stop member 562 a distance that facilitates a higher output pumping operation of the displacement member 521 within the chamber 520 (as compared to the scenario where the inlet valve is caused to travel a greater distance from the valve seat, as described below and shown in FIGS. 7C and 7D). In other words, the inlet valve 570 can open and close in a manner that facilitates a higher volume of fluid being pumped. Thus, the first range of motion established by the movable stop member 562 can facilitate closing of the inlet valve 570 such that movement of the displacement member 521 is operable to provide a first flow rate from the hydraulic supply 512.

On the other hand, when the movable stop member 562 is at the position shown in FIGS. 7C and 7D, with a narrow portion of the wedge configuration engaged with the inlet valve 570, the inlet valve 570 may move within the chamber 520 between the valve seat 571 and the movable stop member 562 as limited by the second range of motion. With the inlet valve 570 movable relative to the chamber 520 as shown in FIGS. 7C and 7D, reciprocal movement of the displacement member 521 within the chamber 520 is less effective, and may be completely ineffective, to pump fluid from the hydraulic supply 512, because as the displacement member 521 moves to generate pressure within the chamber 520 fluid can escape the chamber 520 via the valve 570 due to the large gap between the valve 570 and the valve seat 571. In other words, a reduced amount or no pressure can be created within the chamber 520 by movement of the displacement member 521 when the inlet valve 570 is allowed to move toward or to the extent shown in FIGS. 7C and 7D. Thus, the second range of motion established by the movable stop member 562 can facilitate closing of the inlet valve 570 (i.e., by causing it to travel a greater distance to close) such that movement of the displacement member 521 is operable to provide a second flow rate lower than the first flow rate, depending upon the position of the movable stop member 562. In some cases, the second flow rate may be zero.

In operation, the actuator 544 can be controlled to rapidly insert and retract the movable stop member 562 to various positions to permit or prevent pumping on any given cycle of the displacement member 521 and to vary the flow rate as desired. Thus, the movable stop member 562 can be selectively inserted and retracted to provide a desired flow rate from the hydraulic supply 512. In one aspect, the actuator 544 can require a low power to operate, thereby minimizing the power required to modulate the flow rate provided by the hydraulic supply 512.

Figure 8:
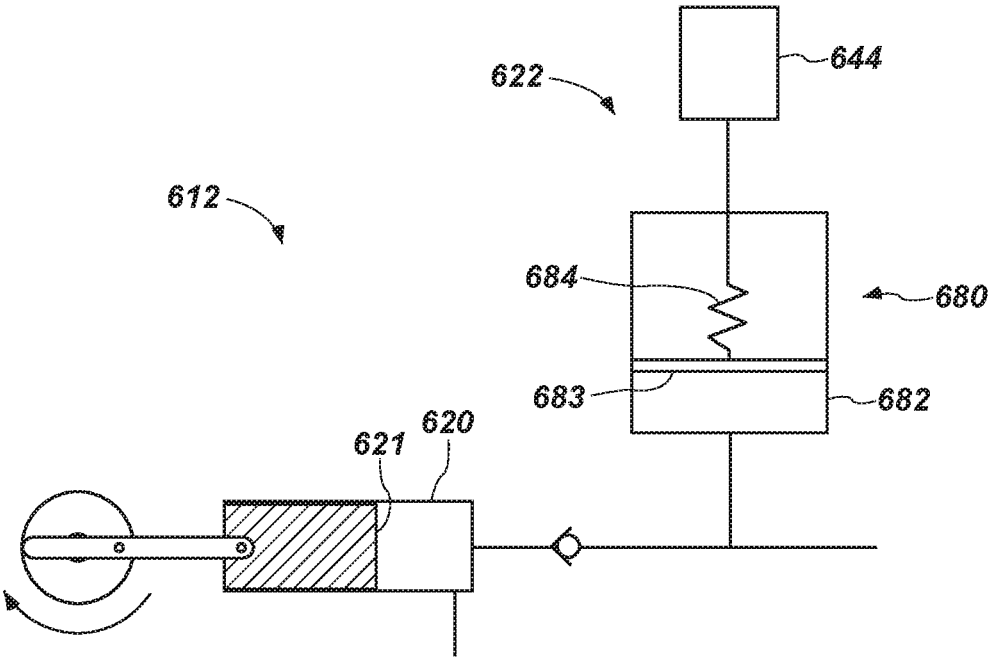
FIG. 8 illustrates a rapidly modulated hydraulic supply in accordance yet another example of the present disclosure.

FIG. 8 illustrates a rapidly modulated hydraulic supply 612 in accordance yet another example of the present disclosure. Non-essential hydraulic fluid plumbing and valving features or components have been omitted for clarity. The hydraulic supply 612 includes a chamber 620, a displacement member 621, and a flow modulation system 622.

The flow modulation system 622 can include an accumulator 680 and an actuator 644 (e.g., a solenoid, an electric motor, a pneumatic actuator, and/or a hydraulic actuator). The accumulator 680 can include a chamber 682 to receive fluid in the hydraulic system and a piston 683 to exert a force against the fluid in the chamber 682. The actuator 644 can be coupled to the piston 683. In one aspect, a spring 684 can be coupled to the piston 683 between the piston 683 and the actuator 644. Thus, when the actuator 644 is off or inactive, the accumulator 680 can function as a normal piston type accumulator.

In operation, however, the actuator 644 can be controlled to rapidly extend and retract the piston 683 to various positions within the chamber 682 to vary the pressure in the system as desired. Thus, the piston 683 can be selectively extended and retracted to provide a desired pressure from the hydraulic supply 612. The spring 683 can smooth the application and removal of pressure to the fluid when the actuator 644 causes the piston 683 to move within the chamber 682. In one aspect, the actuator 644 can require a low power to operate, thereby minimizing the power required to modulate the flow rate provided by the hydraulic supply 612.

A rapidly modulated hydraulic supply as disclosed herein can provide rapid and efficient flow modulation to vary hydraulic system pressure dynamically to follow the instantaneous or average demand of the system (which may include some pressure/power overhead). In other words, the supply pressure and hydraulic power can be modulated to track the instantaneous demand of the actuators, while performing tasks such as walking and running with a load. Varying the supply pressure to optimally adjust system pressure to meet system demands at any given moment in time can save power and minimize undesirable heat generation. For example, by operating with the control ports nearly fully open, orifice losses (e.g., large pressure drops at high flow across pressure regulators and servo-valves used to control joint movement and torque) can be reduced, which minimizes power dissipation while the actuators generate positive power. In addition, the large power losses across pressure regulators are, for the most part, eliminated.

In accordance with one embodiment of the present invention, a method for facilitating pressure and flow rate modulation of a hydraulic supply to track the present demand of an actuator is disclosed. The method can comprise providing a chamber for receiving fluid. The method can also comprise providing a displacement member operable to displace the fluid from the chamber. Additionally, the method can comprise facilitating variable flow rates of the fluid output from the chamber, wherein a first flow rate corresponds to a first output pressure, and is different from a second flow rate corresponding to a second output pressure for a like or similar movement of the displacement member. In one aspect of the method, the chamber can comprise a cylinder and the displacement member can comprise a piston disposed in the cylinder and configured for reciprocal or cyclical movement therein. It is noted that no specific order is required in this method, though generally in one embodiment, these method steps can be carried out sequentially.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A method for facilitating pressure and flow rate modulation of a hydraulic supply to track the present demand of an actuator, the method comprising:

providing a chamber for receiving fluid;

providing a displacement member operable to displace the fluid from the chamber;

providing a flow modulation system having a moveable head disposed in the chamber and opposed to the displacement member, and a range of motion limitation mechanism to limit a range of motion for the moveable head in the chamber between a first range of motion and a second range of motion, the second range of motion being greater than the first range of motion; and facilitating variable flow rates of the fluid output from the chamber via the flow modulation system independent of the operation of the displacement member, wherein a first flow rate corresponds to a first output pressure, and is different from a second flow rate corresponding to a second output pressure for a like movement of the displacement member, wherein the first range of motion is such that movement of the displacement member is operable with the movable head to provide the first flow rate, and wherein the second range of motion is such that movement of the displacement member is operable with the movable head to provide the second flow rate lower than the first flow rate, the second range of motion of the movable head overlapping in space with a range of motion of the displacement member.

2. A rapidly modulated hydraulic supply, comprising:

a chamber for receiving fluid;

a displacement member operable to displace the fluid from the chamber; and a flow modulation system operable to vary the flow rate of the fluid output from the chamber independent of the operation of the displacement member, the flow modulation system having a moveable head disposed in the chamber and opposed to the displacement member, and a range of motion limitation mechanism to limit a range of motion of the moveable head in the chamber between a first range of motion and a second range of motion, the second range of motion being greater than the first range of motion, wherein the flow modulation system is configured to provide a first flow rate that corresponds to a first output pressure, and that is different from a second flow rate corresponding to a second output pressure, wherein the first range of motion is such that movement of the displacement member is operable with the movable head to provide the first flow rate, and wherein the second range of motion is such that movement of the displacement member is operable with the movable head to provide the second flow rate lower than the first flow rate, the second range of motion of the movable head overlapping in space with a range of motion of the displacement member.

3. The rapidly modulated hydraulic supply of claim 2, wherein the movable head is biased toward the displacement member.

4. The rapidly modulated hydraulic supply of claim 3, further comprising a spring to bias the movable head toward the displacement member.

5. The rapidly modulated hydraulic supply of claim 2, wherein the first range of motion is zero.

6. The rapidly modulated hydraulic supply of claim 2, wherein the range of motion limitation mechanism comprises a movable stop member operable with the movable head to provide the first range of motion at a first position and the second range of motion at a second position.

7. The rapidly modulated hydraulic supply of claim 6, wherein the stop member comprises a wedge configuration.

8. The rapidly modulated hydraulic supply of claim 6, wherein the stop member is actuated by a solenoid, an electric motor, a pneumatic actuator, a hydraulic actuator, or a combination thereof.

9. The rapidly modulated hydraulic supply of claim 2, wherein the second flow rate is zero.

10. A rapidly modulated hydraulic supply, comprising:

a chamber for receiving fluid;

a displacement member comprising a piston operable to displace the fluid from the chamber; and a flow modulation system operable to vary the flow rate of the fluid output from the chamber independent of the operation of the displacement member, the flow modulation system having a moveable head disposed in the chamber and opposed to the displacement member, and a range of motion limitation mechanism to limit a range of motion for the moveable head in the chamber between a first range of motion and a second range of motion, the second range of motion being greater than the first range of motion, wherein a first flow rate corresponds to a first output pressure, and is different from a second flow rate corresponding to a second output pressure for a consistent stroke length of the displacement member, wherein the first range of motion is such that movement of the displacement member is operable with the movable head to provide the first flow rate, and wherein the second range of motion is such that movement of the displacement member is operable with the movable head to provide the second flow rate lower than the first flow rate, the second range of motion of the movable head overlapping in space with a range of motion of the displacement member.

* * * * *